US005557962A

United States Patent [19]

Takikawa

[11] Patent Number: 5,557,962

[45] Date of Patent: Sep. 24, 1996

[54] LONG DEFORMED EXTRUDED METALLIC SHAPE AND METHOD FOR MANUFACTURING SAID SHAPE

[75] Inventor: Kazunori Takikawa, Numazu, Japan

[73] Assignee: USUI Kokusai Sangyo Kaisha Ltd., Japan

[21] Appl. No.: 498,107

[22] Filed: Jul. 5, 1995

Related U.S. Application Data

[63] Continuation of Ser. No. 982,732, filed as PCT/JP92/00820, Jun. 29, 1992 published as WO93/00183, Jan. 7, 1993, abandoned.

[30] Foreign Application Priority Data

Jun. 28, 1991 [JP] Japan ..... 3-183363

[51] Int. Cl.[6] ..... B21C 25/08

[52] U.S. Cl. ..... 72/260; 72/264

[58] Field of Search ..... 72/264, 260, 468

[56] References Cited

U.S. PATENT DOCUMENTS

| | | | |
|---|---|---|---|
| 139,946 | 6/1873 | Cunningham | 72/260 |
| 384,956 | 6/1888 | Boll | 72/260 |
| 2,231,336 | 2/1941 | Heron | 72/260 |
| 3,002,615 | 10/1961 | Lemelson | 72/260 |
| 3,350,907 | 11/1967 | McDonald et al. | 72/352.1 |
| 5,022,252 | 6/1991 | Wellman et al. | 72/260 |

FOREIGN PATENT DOCUMENTS

| | | |
|---|---|---|
| 248324 | 10/1990 | Japan . |
| 2290614 | 11/1990 | Japan . |

*Primary Examiner*—Lowell A. Larson
*Attorney, Agent, or Firm*—Anthony J. Casella; Gerald E. Hespos

[57] ABSTRACT

In producing a long extruded metal article of miscellaneous shapes, no post-working such as cutting is applied to the shaped long metal billet but extrusion of the metal billet and formation of miscellaneous shapes of the extruded article are effected both at a time for efficient production of the article. Since the metal flow of the extruded article is not cut, the extruded article has improved mechanical strength, especially fatigue-resistant strength.

In extruding a long metal billet with an extruder, a die equipped with at least one hole section-varying device capable of acting due to a cylinder device or the like is employed with suitably varying the hole section profile of the die during extrusion so that a long extruded metal article of miscellaneous shapes where the section profile of at least the lengthwise direction of it varies is obtained.

3 Claims, 8 Drawing Sheets

LONG DEFORMED EXTRUDED METALLIC SHAPE AND METHOD FOR MANUFACTURING SAID SHAPE

This application is a continuation of application Ser. No. 07/982,732, filed as PCT/JP92/00820, Jun. 29, 1992 published as WO93/00183, Jan. 7, 1993, now abandoned.

TECHNICAL FIELD

The present invention relates to a long extruded metal article of miscellaneous shapes, which is employed as spars for aircraft, shaped articles for structures, metal pipes such as high-pressure fuel ducts of cars and others, and rod-like or tubular parts for general machine structures or pipe lines, and also to a method of producing the same.

BACKGROUND ART

Main spars for aircraft, having a tapered shape to the lengthwise direction thereof, have been produced by cutting a shaped article having a uniform sectional shape with an expensive NC spar mirror, NC plano-mirror, NC profiler or the like by many working steps. As unworked billets or pipes for high-pressure fuel ducts for cars and others, metal pipes of miscellaneous shapes with uneven thickness, such as those shown in FIG. 3 and FIG. 4, have been employed. Heretofore, such pipes have been produced by shaping a pipe with uneven thickness by casting or extrusion of an unworked billet 9', as shown in FIG. 11 and FIG. 12, followed by cutting the thick portion 9" of it with a milling cutter or the like, as shown in FIG. 13 and FIG. 14.

However, the working process is uneconomical and unfavorable since it needs much time and much labor and additionally generates a large amount of shavings in the cutting step. In addition, since the metal flow m' of the product obtained is cut in the middle thereof due to the cutting operation, the product often has another problem that the strength thereof lowers.

The object of the present invention is to overcome the above-mentioned problems and to provide a long extruded metal article of miscellaneous shapes and a method of producing it, in which a long metal billet is extruded to give a sectional profile of miscellaneous shapes in the lengthwise direction of the extruded and shaped metal article so that the additional working of the shaped metal article for reducing the thick wall portion thereof by cutting or the like operation is minimized.

DISCLOSURE OF INVENTION

In order to attain the above-mentioned object, the first embodiment of the present invention resides in a subject matter of providing a long extruded metal article of miscellaneous shapes in which the sectional profile of at least the lengthwise direction thereof is partly different; and the second embodiment of the same resides in a subject matter of-providing a method of producing a long extruded metal article of miscellaneous shapes by extruding a long metal billet with an extruder, in which a die equipped with at least one section-varying device capable of acting due to a cylinder device or the like is employed with suitably varying the section profile of the die so that the section profile of at least the lengthwise direction of the long metal billet is thereby partly varied during extrusion of it.

In accordance with the present invention for extrusion of a long metal billet with an extruder, the section profile of the die as equipped in the extruder is freely varied during operation of continuous extrusion whereby the thickness of the wall of the long shaped metal article is partly varied along the lengthwise direction thereof or along both the lengthwise direction and thickness direction thereof. Thus, extrusion of a long metal billet and formation of miscellaneous shapes in the long extruded metal article may be effected both at a time in the present invention, so that the manufacture equipments for producing a long extruded metal article of miscellaneous shapes having a partly different wall thickness may be simplified and additionally the producibility of producing the product and the utility of the raw material used may be elevated much.

Moreover, the additional working of the extruded article thus obtained, for example, by cutting it may be at least minimized and the metal flow of the article is not almost cut. Therefore, the mechanical strength of the article, especially the fatigue-resistant strength thereof, is noticeably improved.

The present invention will be explained with reference to a pipe as one example. As an extruder, a horizontal or vertical one optionally equipped with a mandrel, which has heretofore been utilized for extruding pipe articles and the like, may be employed. The extruding operation with it may be effected in accordance with a procedure of extruding metal pipes or the like by an ordinary hot extruding method. First, a heated billet of a desired metal is inserted into the container of an extruder. The billet may be either an ordinary billet or a hollow billet.

The billet as inserted into the container is introduced into the die as disposed at the edge of the container by continuously pressing it with an extrusion ram, where it is shaped into a pipe. The section profile of the primary pipe thus formed depends upon the section profile of the hole of the die through which the pipe passes first. Next, during passing the pipe through the die, at least the section-varying device of the die is suitably operated so that the section profile of the lengthwise direction of the pipe may be varied to a determined shape.

As the kind of the metal to be employed in the present invention, suitably mentioned are copper, aluminium, magnesium, zinc, tin, lead and alloys of them of having suitable plastic fluidity during hot operation. The temperature of extruding the metal may be in any temperature range for conventional hot extrusion. For instance, for extruding copper and copper alloys, a suitable temperature may be selected from the range of 620° to 950° C.; for aluminium and aluminium alloys, it may be from 370° to 550° C.; for magnesium and magnesium alloys, it may be from 320° to 430° C.; for zinc and zinc alloys, it may be from 250° to 380° C.; for tin and tin alloys, it may be from 50° to 70° C.; and for lead and lead alloys, it may be from 170° to 230° C.

In the present invention, at least one section-varying device to be provided in the die as disposed at the edge of the container of the extruder is composed of a tabular or rod-like pressure part, which projects to the surface of the die at an angle almost perpendicular to the axis of it in a suitable lengthwise site of the die hole, and a means of operating the pressure part. Since the die section-varying device is one which acts to partly vary the wall thickness of the primary long metal billet as formed by extrusion, it is necessary to impart to the means of operating the pressure part a sufficient pressure enough to result in plastic deformation of a part of the metal tissue of the extruded long metal billet. For this, for instance, employment of a driving means having a strong pressure power, such as an oil pressure cylinder device or the like, is suitable. In addition, since formation of miscellaneous profiles in the long metal billet by extrusion is accompanied by plastic deformation of the metal tissue of itself, the primary shaped long metal billet must maintain plastic deformability to such a degree as having sufficient plastic fluidity in operating the section-varying device, and therefore, when the kind of the alloy to be shaped or the shape itself of the long metal billet of miscellaneous shapes as shaped are complicated, it is necessary to embed a heating means into the die including the section-varying device so as to intentionally facilitate the plastic deformation of the primary shaped long metal billet.

The section profile of the primary extruded long metal billet may be selected depending upon the object of the final article to be obtained, such as spars, shaped articles, pipes with uniform wall thickness or pipes of uneven wall thickness, and the operation of driving the section-varying device may be effected suitably depending upon the shape of the intended long shaped metal article of miscellaneous shapes as the final product. Specifically, if the portion of the long metal billet where the section profile thereof is to be varied extends widely, the projection of the pressure part of the section-varying device is continued for a determined period of time along with continuous extrusion of the billet. On the other hand, if the portion of it where the section profile thereof is to be varied is limited to only the width of the pressure part, the extrusion operation is stopped for a while with effecting projection of the pressure part during the time so as to vary the section profile of the long metal billet and thereafter the extrusion operation is continued for intermittent extrusion with driving the section-varying device.

By simultaneously effecting both projection of the pressure part and extrusion of the billet, the both parts of the lengthwise direction of the projected thick wall part of the billet may be tapered to give a continuous and smooth shape thereto.

BEST MODE FOR CARRYING OUT THE INVENTION

Figure 1:
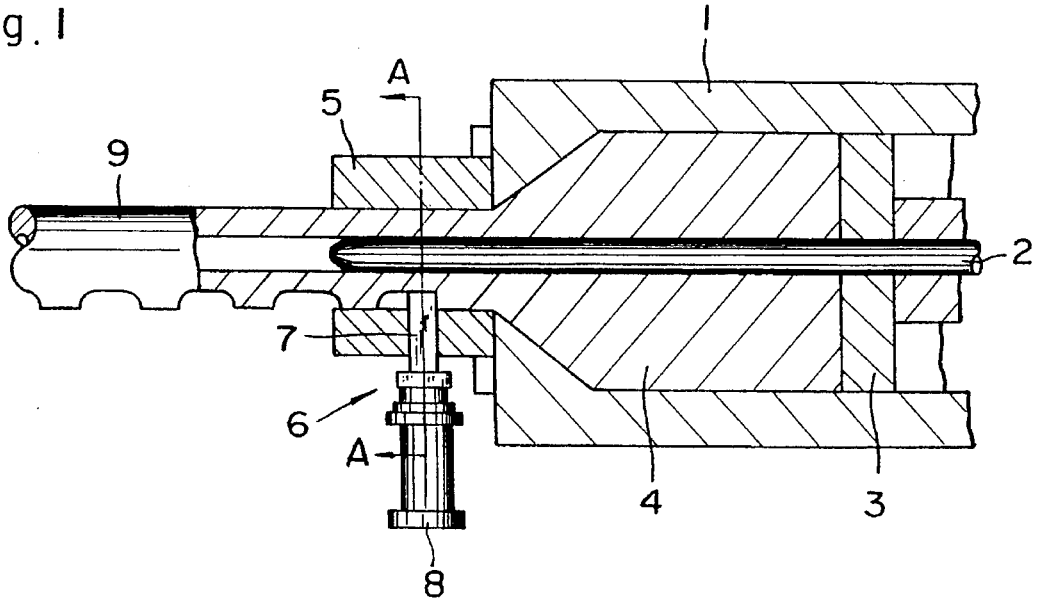
FIG. 1 is a side sectional view of showing an outline of the extruder device to be employed in carrying out the present invention.
Figure 2:
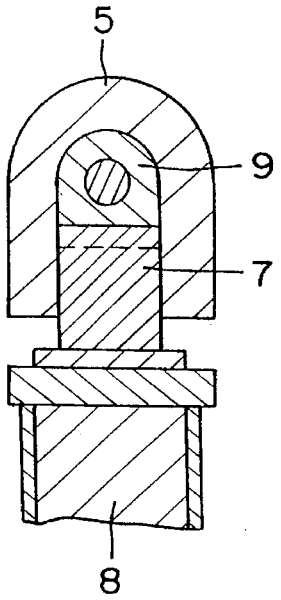
FIG. 2 is an A—A line cross-sectional view of FIG. 1.

Next, the present invention will be explained in more detail by way of an example of producing a copper pipe of miscellaneous shapes with uneven thickness for a billet of a high-pressure fuel duct. FIG. 1 is a sectional view of an extruder device to be employed in the example; and FIG. 2 is an A—A line cross-sectional view of FIG. 1. In the drawings, 1 is a container, 2 is a mandrel, 3 is a pressure rum, and 4 is a copper billet. 5 is a die as provided at the top opening of the container 1, 6 is a die section-varying device as provided in die 5, 7 is a tabular pressure part in the die section-varying device, and 8 is an oil pressure cylinder device for operating the pressure part. 9 is a copper pipe of miscellaneous shapes with uneven thickness to be obtained, which is for a billet of a high-pressure fuel duct.

Figure 3:
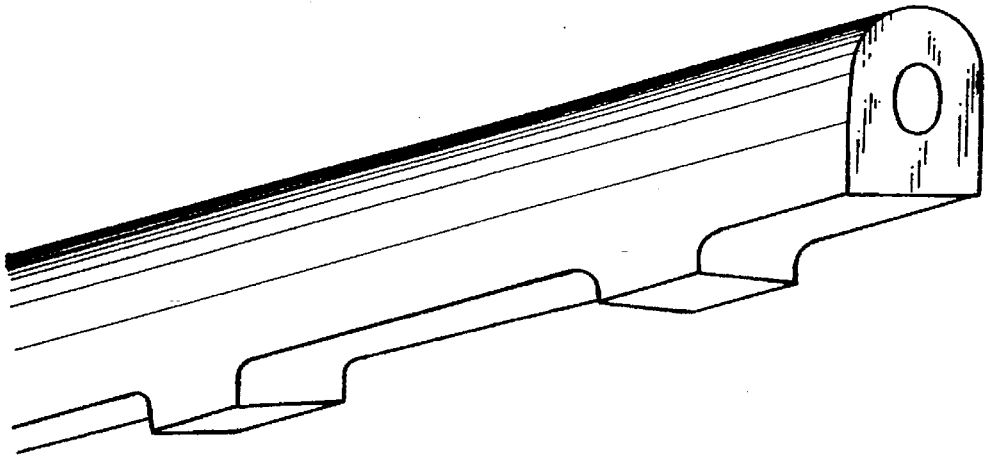
FIG. 3 is a perspective view of showing one embodiment of a long copper pipe of miscellaneous shapes for a billet of a high-pressure fuel duct, as obtained by the method of the present invention.

As the extruder, employed was a horizontal extruder. A copper billet 4 as heated up to about 900° C. was inserted into the container 1 and passed through the die 5 by extrusion into Ar atmosphere at a mean extruding rate of 7 m/min, by operating the pressure ram 3, to thereby obtain an uneven pipe having an enlarged wall thickness in the lower portion thereof as a primary profile. The operation was continued further with lowering the extruding rate, while the oil pressure cylinder 8 of the die section-varying device 6 was operated so that the pressure part 7 was projected to the determined site in the die to thereby vary the section profile of the pipe. Thus, a copper pipe of miscellaneous shapes for a billet of a high-pressure fuel duct, as shown in FIG. 3, was obtained.

Figure 4:
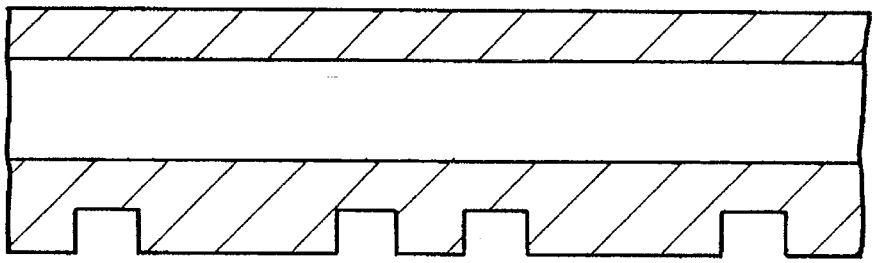
FIG. 4 is a horizontal center sectional view of showing another embodiment of a long copper pipe of miscellaneous shapes for a billet of a high-pressure fuel duct, as obtained by the method of the present invention.

Next, using the same extruder device as in the above-mentioned example, the extrusion operation was stopped for a while and the pressure part 7 of the section-varying device 6 was projected for effecting variation of the section of only the part of the pipe corresponding to the width of the pressure part. Thereafter, the same operation as in the above-mentioned example was carried out except that the operation of continuing the extrusion was repeated at suitable intervals, and a copper pipe of miscellaneous shapes for a billet of a high-pressure fuel duct, having a different profile from that of the above-mentioned example as shown in FIG. 4 as its side sectional view, was obtained.

The above-mentioned two examples demonstrate the method of the present invention by way of an embodiment of producing a copper pipe of miscellaneous shapes for a billet of a high-pressure fuel duct. In addition to them, the present invention may apply to production of other various profiles of long extruded hollow or solid metal article of miscellaneous shapes.

Figure 5:
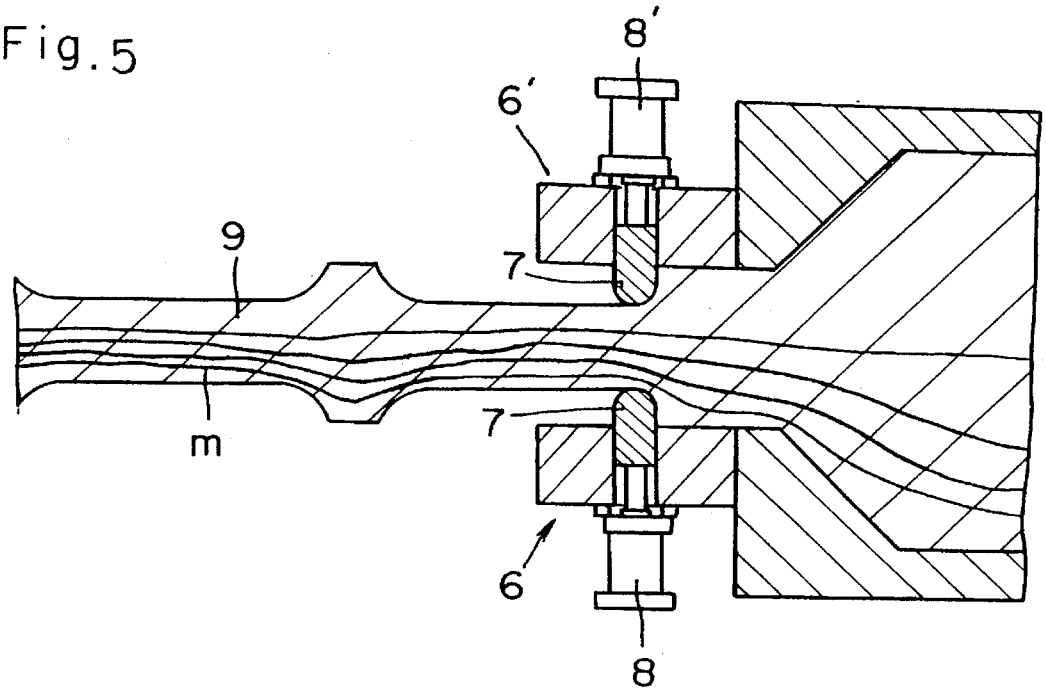
FIG. 5 is a partly enlarged side sectional view of the essential part of another embodiment of the extruder device to be used in the present invention.
Figure 6:
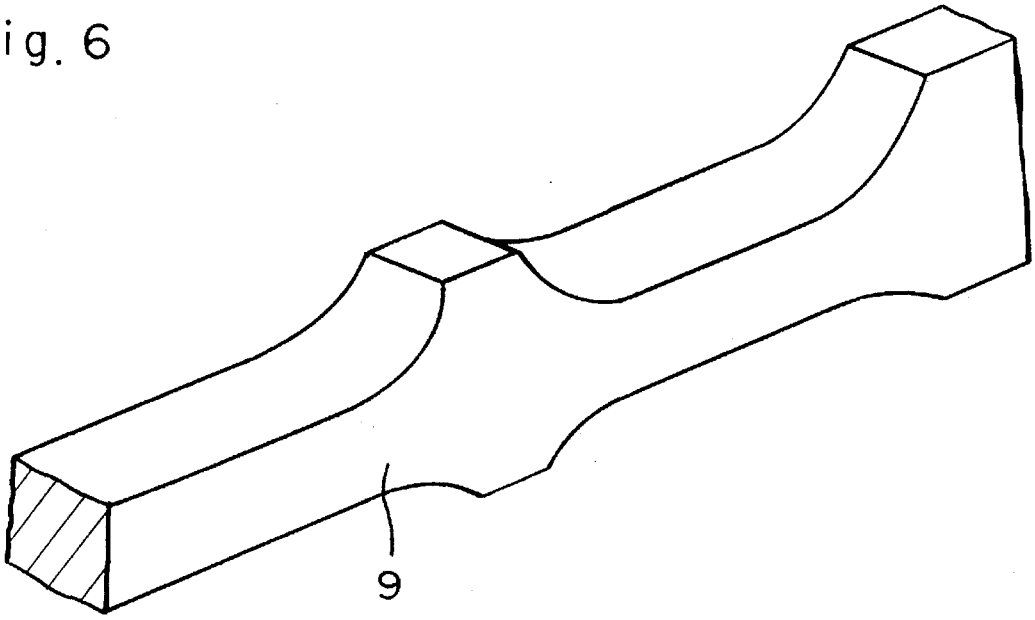
FIG. 6 is a perspective view of an extruded article as obtained by the use of the device of FIG. 5.
Figure 7:
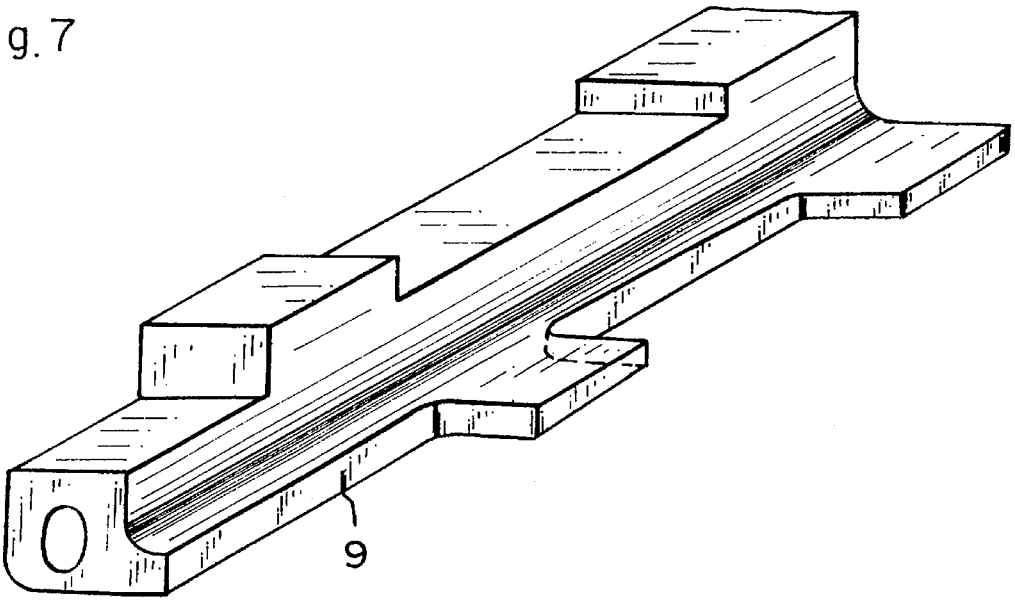
FIG. 7 is a perspective view of still another extruded article.
Figure 8:
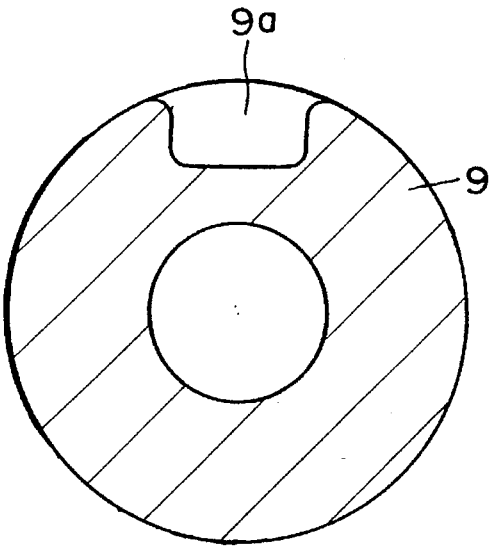
FIG. 8 is a vertical sectional view of still another extruded article.

For instance, as shown in FIG. 5, die section-varying devices 6, 6', each composed of pressure parts 7, 7' and oil pressure cylinder devices 8, 8', respectively, are provided in the both facing sides of the die 5, and operation of the section-varying devices 6, 6' and extrusion are simultaneously effected to obtain a solid extruded article of FIG. 6 where the section profile of the lengthwise direction of it varies continuously and smoothly. In addition, where the section-varying devices 6, 6' are disposed in the die in such a way that they are almost perpendicular to each other and the operating time of the respective section-varying devices is made different from each other, then an extruded article having a profile of FIG. 7 may be obtained where the phase of the respective thick parts varies from each other. Further, where the profile of the pressure part 7 is varied, then an extruded article having continuous or intermittent hollows 9*a* . . . of FIG. 8 each with a varying depth may be obtained.

Figure 9:
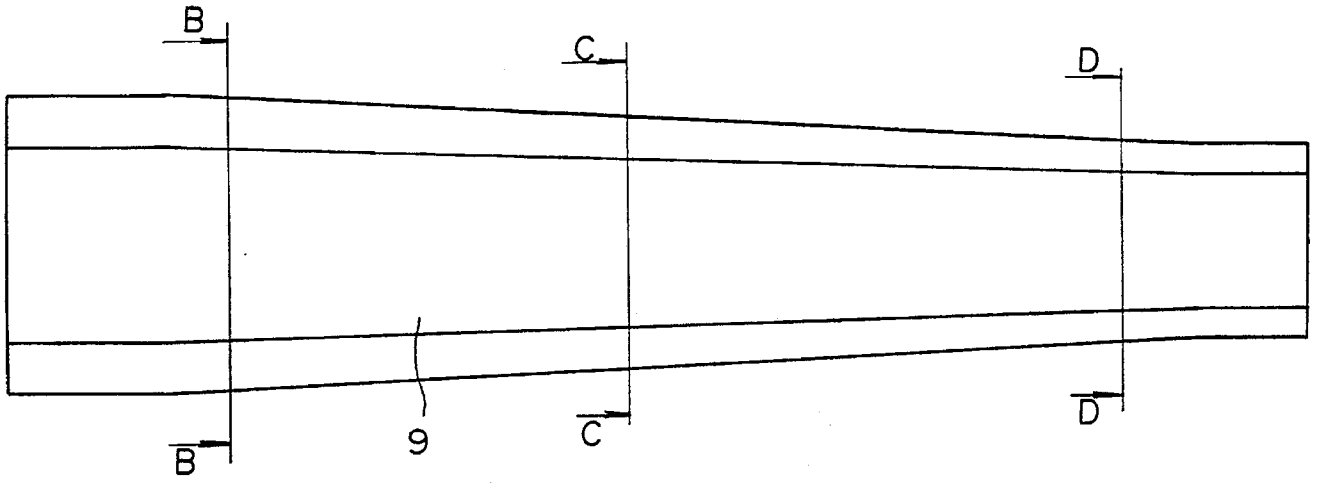
FIG. 9 is a side plan view of still another main spar.
Figure 9C:
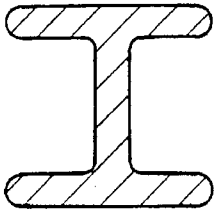
FIG. 9*a*, FIG. 9*b* and FIG. 9*c* each are B—B, C—C and D—D sectional views of FIG. 9, respectively.
Figure 9B:
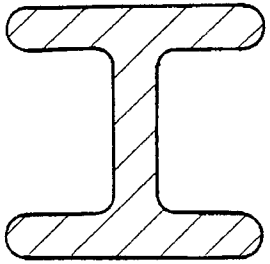
Figure 9A:
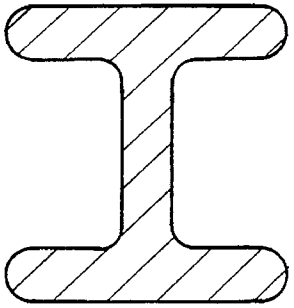
Figure 10:
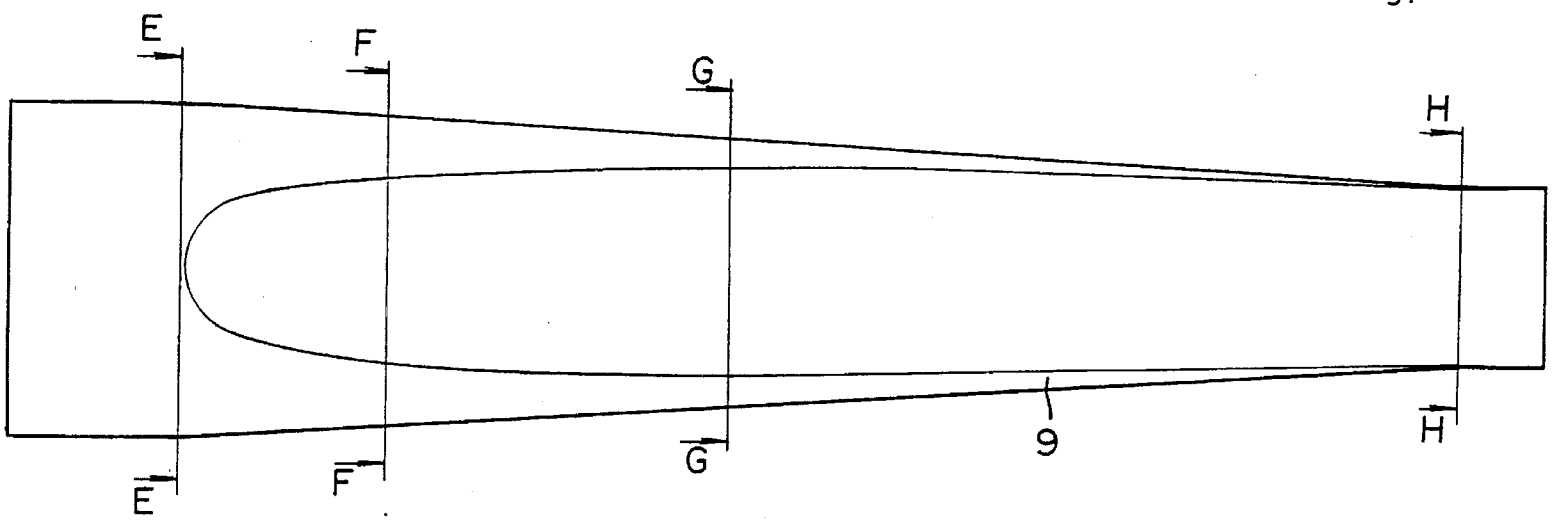
FIG. 10 is a side plan view of still another extruded article.
Figure 10D:
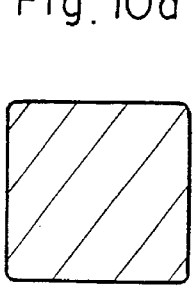
FIG. 10*a*, FIG. 10*b*, FIG. 10*c* and FIG. 10*d* each are E—E, F—F, G—G and H—H sectional views of FIG. 10, respectively.
Figure 10C:
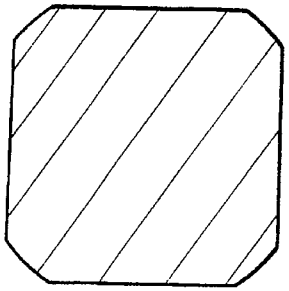
Figure 10B:
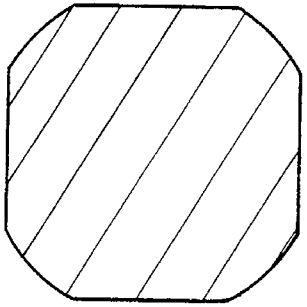
Figure 10A:
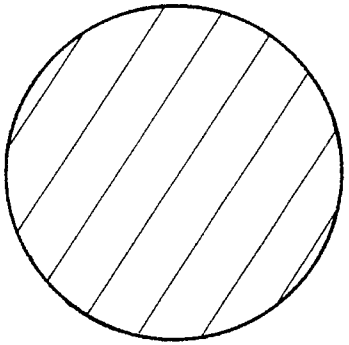
Figure 11:
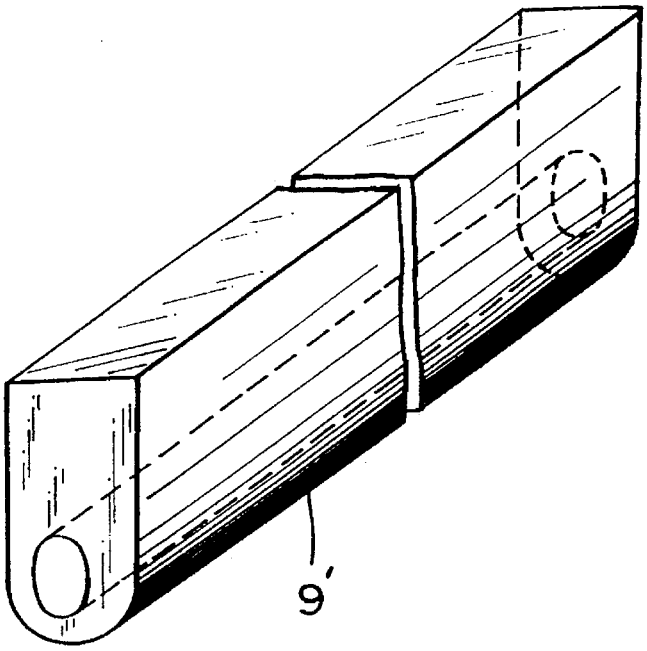
FIG. 11 is a perspective view of an extruded billet of a conventional example.
Figure 12:
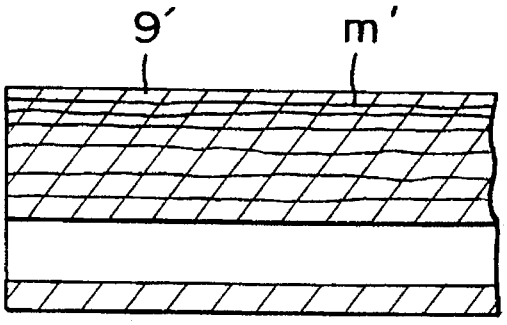
FIG. 12 is a horizontal center sectional view of FIG. 11.
Figure 13:
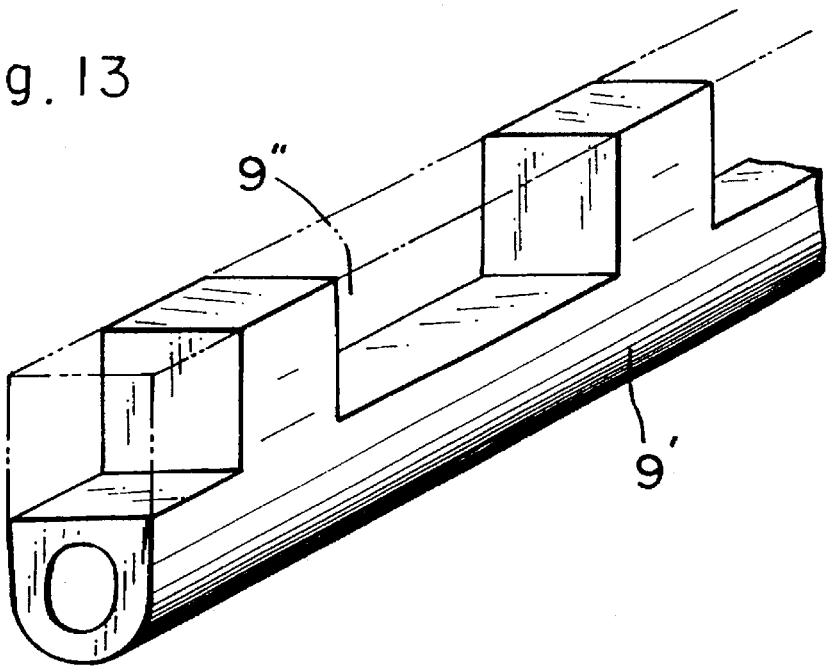
FIG. 13 is a perspective view of a product as obtained by a conventional example.
Figure 14:
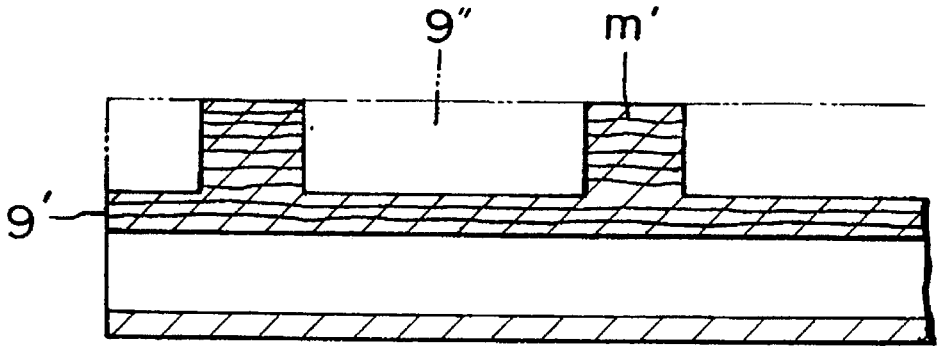
FIG. 14 is a horizontal center sectional view of FIG. 13.

In additions, in accordance with the present invention of using an aluminium alloy for a main spar for the main wing of an aircraft, an extruded article 9 having a tapered profile in the lengthwise direction and having a reduced section in the thickness direction, as shown in FIG. 9, or an extruded article 9 having a tapered profile in the lengthwise direction and having a gradually varying section profile from a circular profile to a square profile, as shown in FIG. 10 may also be obtained.

The obtained metal flow will be explained with reference to FIG. 5. The metal flow obtained is extremely smooth and is not cut. Even if it is cut or machined further for partly reducing the thickness, the cutting operation may be minimized in accordance with the present invention. Therefore, as compared with a shaped article of a conventional embodiment where the metal flows m' . . . which are almost parallel to each other to the lengthwise direction are completely cut by cutting or the like machining operation, the shaped article of the present invention has much improved mechanical strength, especially fatigue-resistant strength.

INDUSTRIAL APPLICABILITY

As mentioned above, in accordance with the present invention of producing a long extruded metal article of miscellaneous shapes by extrusion, any cutting operation with a spar mirror, profiler, milling machine or the like is unnecessary but the intended long extruded metal article of miscellaneous shapes may be produced in one step of extrusion only. Therefore, not only the present invention is extremely efficient but also it is highly economical as it has no cutting step and therefore does not yield any cut shavings. In addition, since the extruded article is free from cutting of the metal flow of itself, it has excellent mechanical strength, especially fatigue-resistant strength.

I claim:

1. A method of producing an elongate high pressure fuel duct with spaced apart regions of enlarged thickness on one longitudinal side, characterized by: providing a container for a flowable metal having an elongate die defining a horizontal passage for receiving the flowable metal from the container, said passage being of uniform cross-sectional shape along its length, said cross-sectional shape comprising a cylindrically generated top surface and a rectilinearly generated bottom surface extending from said cylindrically generated surface; inserting a cylindrical mandrel through said container and through said elongate die, said cylindrical mandrel being concentrically disposed relative to said cylindrically generated top surface of said elongate die to define a nominal radial thickness, and said mandrel being spaced from said bottom surface of said die a distance equal to the enlarged thickness, said enlarged thickness being greater than said radial thickness; urging the flowable metal from the container and through the passage of the die in surrounding relationship to said mandrel for producing the high pressure fuel duct supported and defined by said die and said mandrel, such that portions of said fuel duct between said mandrel and said bottom surface of said die define said enlarged thickness; intermittently moving a forming device vertically Upwardly from the bottom surface into the passage of said die intermediate the length of the die and orthogonally to said mandrel for intermittently producing regions of reduced cross-sectional area and a reduced thickness along portions of the fuel duct between mandrel and the bottom surface of the die, said moving of the forming device being carried out to form a concave curved transition between the regions of reduced thickness and the regions of enlarged thickness for achieving a smooth uninterrupted metal flow through said transitions with an enhanced strength, whereby portions of the die adjacent the forming device resist forces on the forming device by the flowable metal and support the flowable metal in proximity to the forming device.

2. The method of claim 1, further comprising the step of periodically heating the die while varying the cross-sectional profile of the duct.

3. The method of claim 1, further comprising the step of altering operational speeds of the extruder while varying the cross-sectional profile of the duct such that the operational speeds of the extruder conform to cross-sectional areas of the duct.

* * * * *